US012325498B1

(12) United States Patent
Dildy

(10) Patent No.: US 12,325,498 B1
(45) **Date of Patent: *Jun. 10, 2025**

(54) BOAT CRADLE ASSEMBLY FOR BOAT TRANSPORT AND DRY STORAGE

(71) Applicant: Veeline Marine Equipment, LLC, Denver, NC (US)

(72) Inventor: Marshall Glenn Dildy, Denver, NC (US)

(73) Assignee: Veeline Marine Equipment, LLC, Denver, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/227,075

(22) Filed: Jul. 27, 2023

Related U.S. Application Data

(63) Continuation of application No. 17/549,188, filed on Dec. 13, 2021, now Pat. No. 11,738,836.

(51) Int. Cl.
*B63C 5/02* (2006.01)
*B63C 15/00* (2006.01)

(52) U.S. Cl.
CPC ..... *B63C 5/02* (2013.01); *B63C 15/00* (2013.01)

(58) Field of Classification Search
CPC ..... B63C 5/02; B63C 15/00
See application file for complete search history.

(56) References Cited

U.S. PATENT DOCUMENTS

| | | | | |
|---|---|---|---|---|
| 5,011,357 | A | 4/1991 | Studier | |
| 10,858,083 | B1 * | 12/2020 | Basta | B63C 3/12 |
| 11,738,836 | B1 | 8/2023 | Dildy | |
| 2009/0031939 | A1 | 2/2009 | Fishburn | |
| 2012/0312214 | A1 | 12/2012 | Hey | |
| 2013/0025519 | A1 | 1/2013 | Cooney | |
| 2014/0010593 | A1 | 1/2014 | Davis | |
| 2021/0016861 | A1 * | 1/2021 | Peterson | E02C 3/00 |

* cited by examiner

*Primary Examiner* — Andrew Polay
(74) *Attorney, Agent, or Firm* — Schwartz Law Firm, P.C.

(57) ABSTRACT

A boat cradle assembly is adapted for dry storage of a pontoon boat having a deck and a hull. The hull includes a tubular midline pontoon. The boat cradle assembly comprises first and second spaced apart longitudinal side beam. A plurality of crossbeams extends between the first and second side beams. Each crossbeam has a substantially V-shaped bottom structure and a top structure. The V-shaped bottom structure is configured to reside between and engage spaced apart frame members of a dry storage rack. The top structure defines an intermediate arcuate formation configured to accommodate a rounded underside of the midline pontoon.

9 Claims, 8 Drawing Sheets

BOAT CRADLE ASSEMBLY FOR BOAT TRANSPORT AND DRY STORAGE

TECHNICAL FIELD AND BACKGROUND OF THE DISCLOSURE

The present disclosure relates broadly and generally to a boat cradle assembly for boat transport and dry storage. The present disclosure is especially applicable for use with boat handling equipment, such as marine forklifts, to lift boats from the water and transport them to a facility or structure for dry storage. In one embodiment, the exemplary cradle assembly incorporates structural features particularly configured to accommodate triple-hull luxury pontoon boats.

Triple-hull luxury pontoon boats (or "tri-toons") have a center pontoon at the boat midline and outside pontoons arranged along the port and starboard sides of the boat. Such boats are becoming an increasingly popular choice among boat owners who are looking for watercraft that can comfortably accommodate large families or groups of people. Luxury pontoon boats usually range from 14 to 30 feet in length, and may come with high-end customized interiors and any number of expensive accessories. Given the considerable financial investment, many pontoon boat owners desire an alterative to wet storage slips which are often poorly guarded and leave the boat exposed to outside environmental elements and water induced inconveniences, such as mildew.

Conventional dry stack buildings (commonly referred to as "barns") are generally large steel structures with racks on either side of the building and an aisle in the center for forklifts and other boat handling equipment. The racks stack and store boats in elevated bays on as many as 3-5 different levels. Most dry stack buildings can handle boat sizes from 35-50. In exemplary embodiments, the present boat cradle assembly facilitates the process of lifting the boat from the water, transporting to a dry storage facility, and then placing into a selected bay of the storage rack.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a boat cradle assembly adapted for dry storage of a pontoon boat having a deck and a hull. The hull includes a tubular midline pontoon. The boat cradle assembly comprises first and second spaced apart longitudinal side beam. A plurality of crossbeams extends between the first and second side beams. Each crossbeam has a substantially V-shaped bottom structure and a top structure. The V-shaped bottom structure is configured to reside between and engage spaced apart frame members of a dry storage rack. The top structure defines an intermediate arcuate formation configured to accommodate a rounded underside of the midline pontoon.

According to another exemplary embodiment, the boat cradle assembly includes first and second pairs of cooperating longitudinal bunk boards extending adjacent respective side beams. The pairs of bunk boards are configured to engage respective tubular outside pontoons along port and starboard sides of the boat.

According to another exemplary embodiment, each pair of cooperating bunk boards extends continuously from one end of the boat cradle assembly to an opposite end of the boat cradle assembly.

According to another exemplary embodiment, the boat cradle assembly includes angled metal bunk brackets. The bunk brackets mount the pairs of cooperating bunk boards to the side beams at opposite ends of the crossbeams.

According to another exemplary embodiment, the V-shaped bottom structure of each crossbeam comprises spaced apart reinforcing gussets.

According to another exemplary embodiment, a longitudinal center beam is attached to the plurality of crossbeams.

According to another exemplary embodiment, the center beam is affixed to each crossbeam at a vertex of the V-shaped bottom structure.

According to another exemplary embodiment, the intermediate arcuate formation of each crossbeam extends along less than 50% of an entire length of the crossbeam.

According to another exemplary embodiment, the intermediate arcuate formation of each crossbeam has a centerpoint depth of less than 6 inches.

According to another exemplary embodiment, the boat cradle assembly includes a plurality of vertical legs. The vertical legs extend downward from the side beams beyond a vertex of each crossbeam.

According to another exemplary embodiment, the boat cradle assembly includes flat metal leg brackets. The leg brackets mount the vertical legs adjacent to the side beams at opposite ends of the crossbeams.

According to another exemplary embodiment, each leg has an enlarged flat foot plate.

According to another exemplary embodiment, the crossbeams are fabricated of aluminum.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
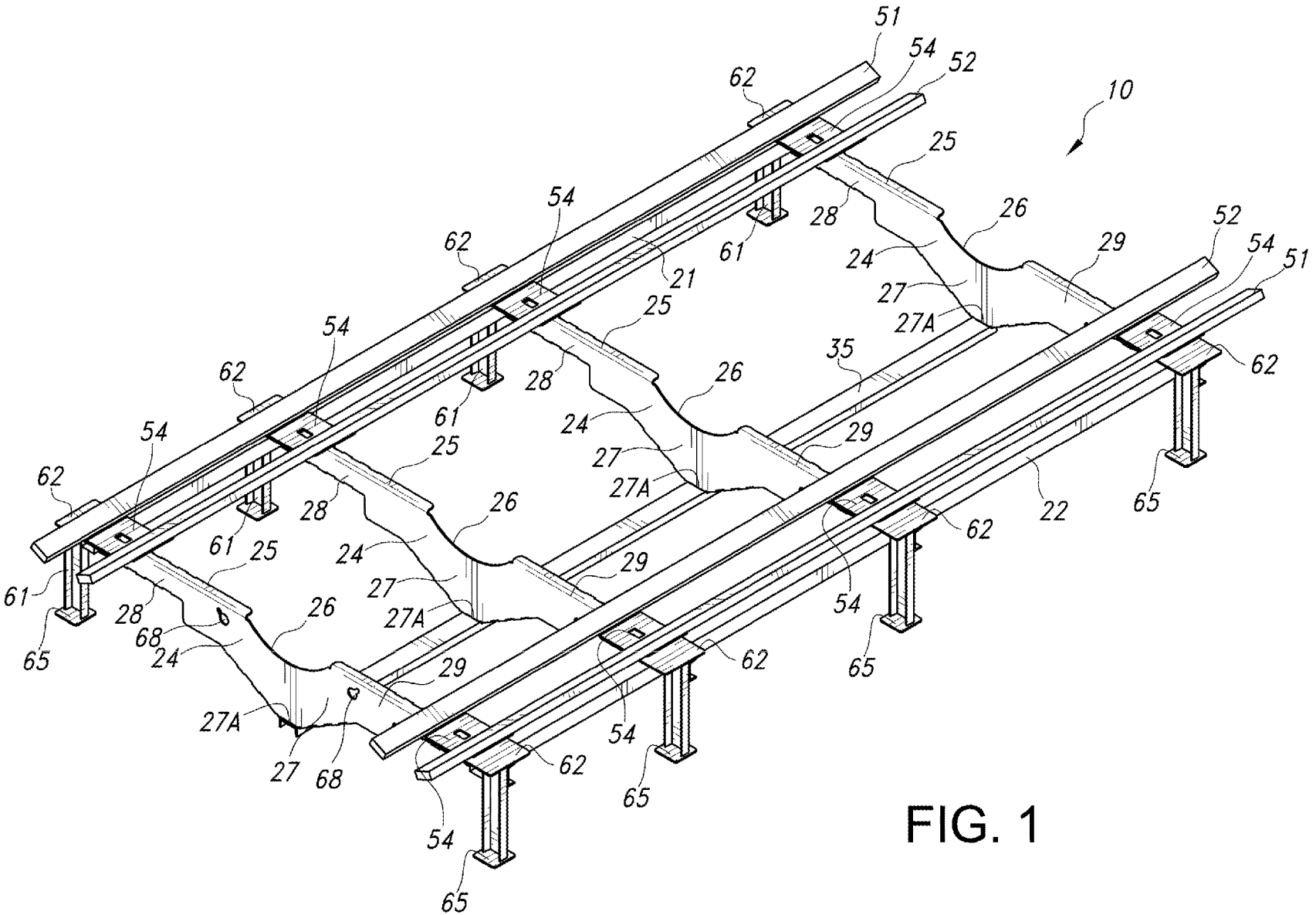
FIG. 1 is a top perspective view of a boat cradle assembly according to one exemplary embodiment of the present disclosure.
Figure 2:
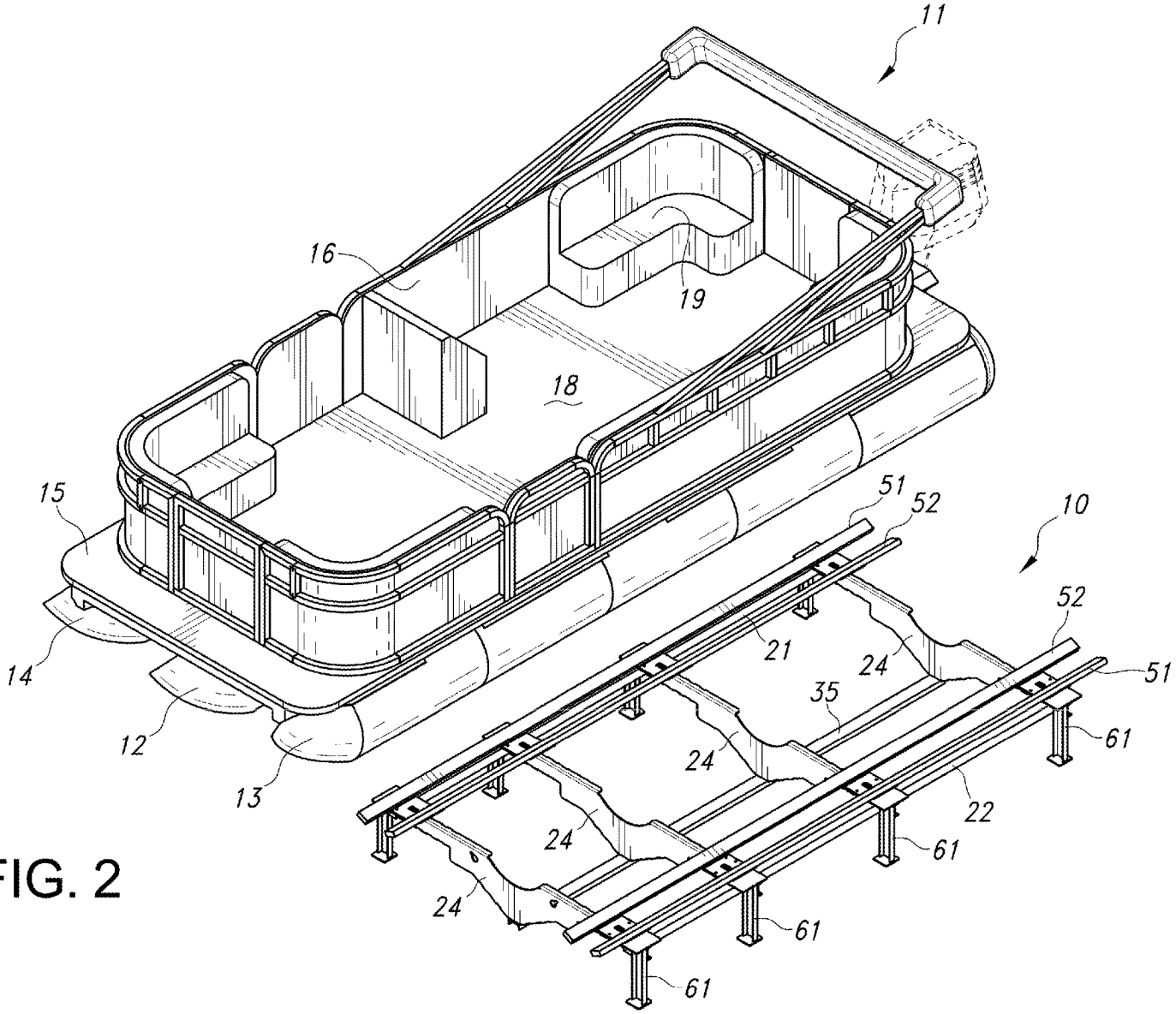
FIG. 2 is a further perspective view of the exemplary boat cradle assembly, and showing a conventional multi-hull pontoon boat positioned above the assembly.
Figure 3:
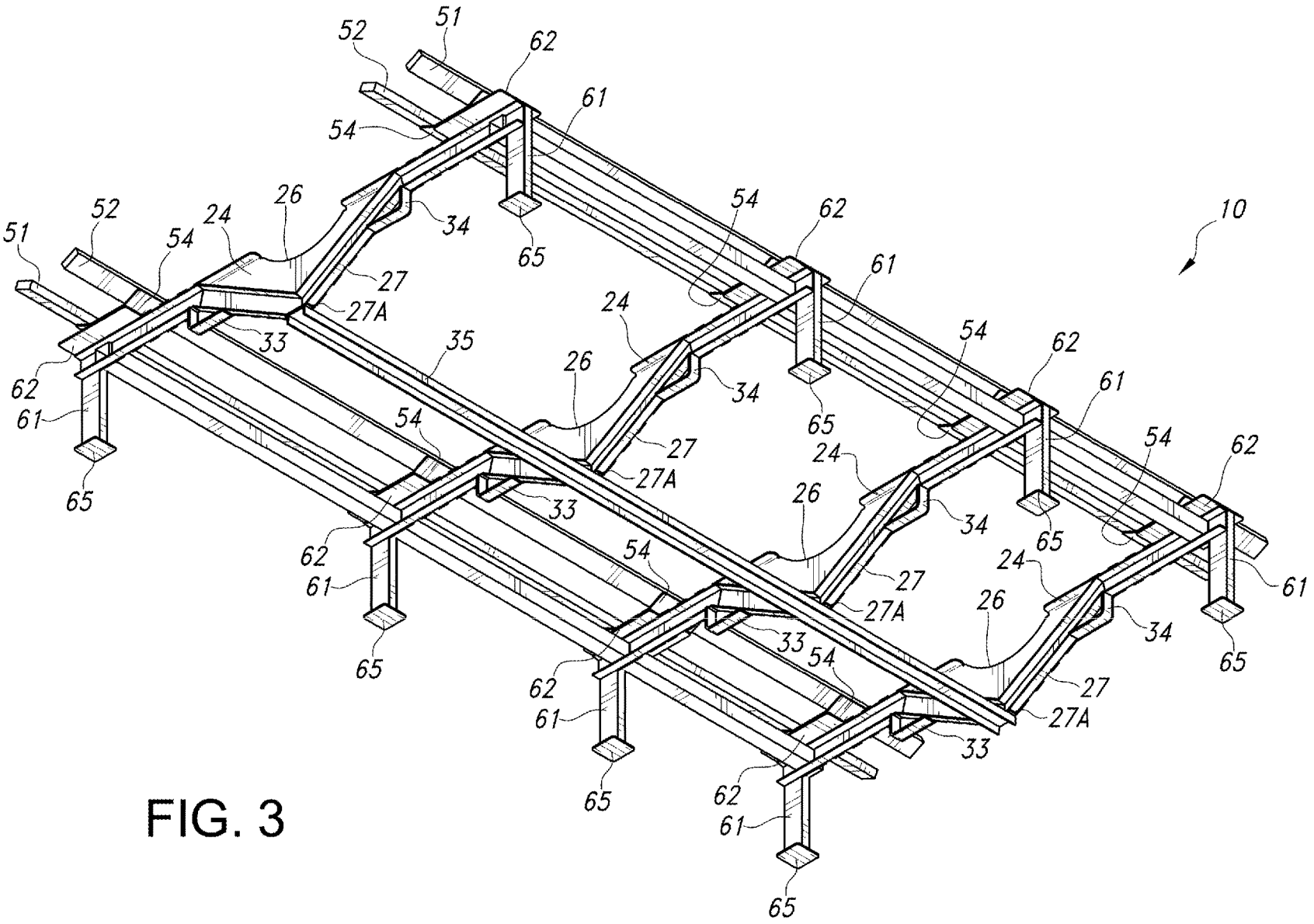
FIG. 3 is a bottom perspective view of the exemplary boat cradle assembly.
Figure 4:
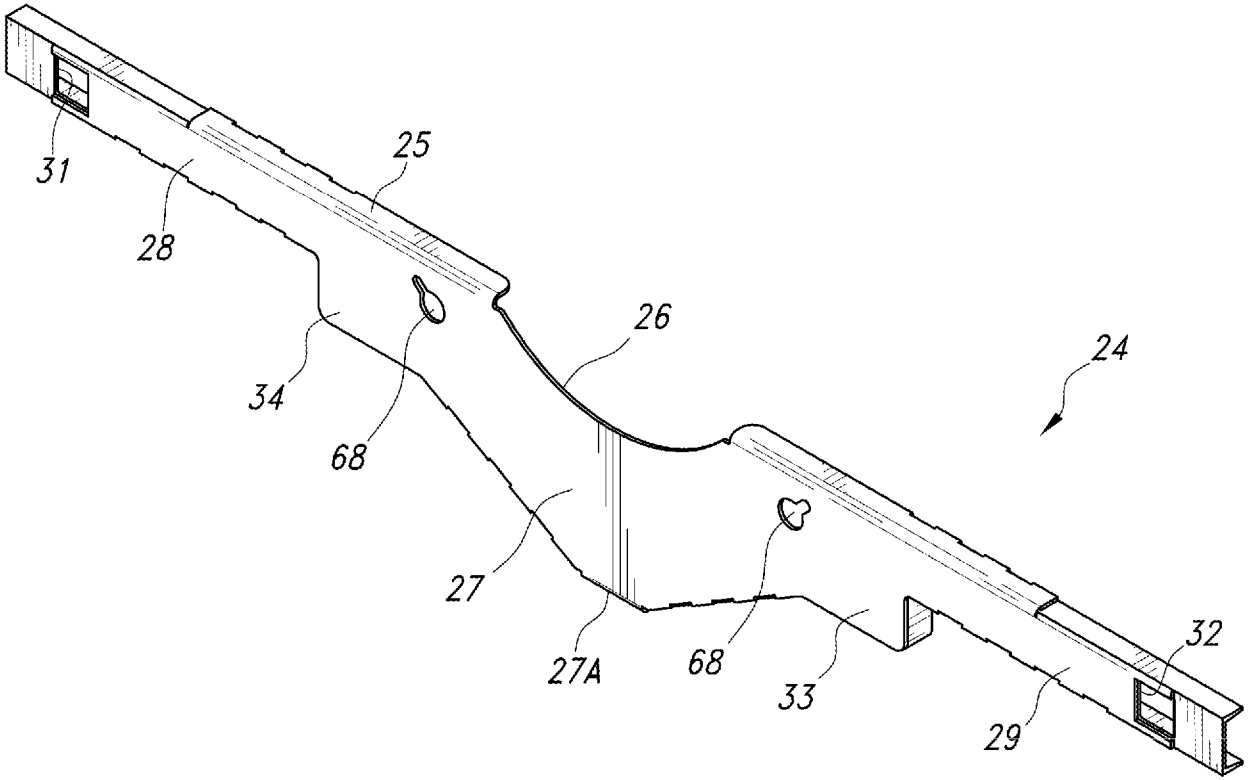
FIG. 4 is a front perspective view of an exemplary crossbeam incorporated in the present boat cradle assembly.
Figure 5:
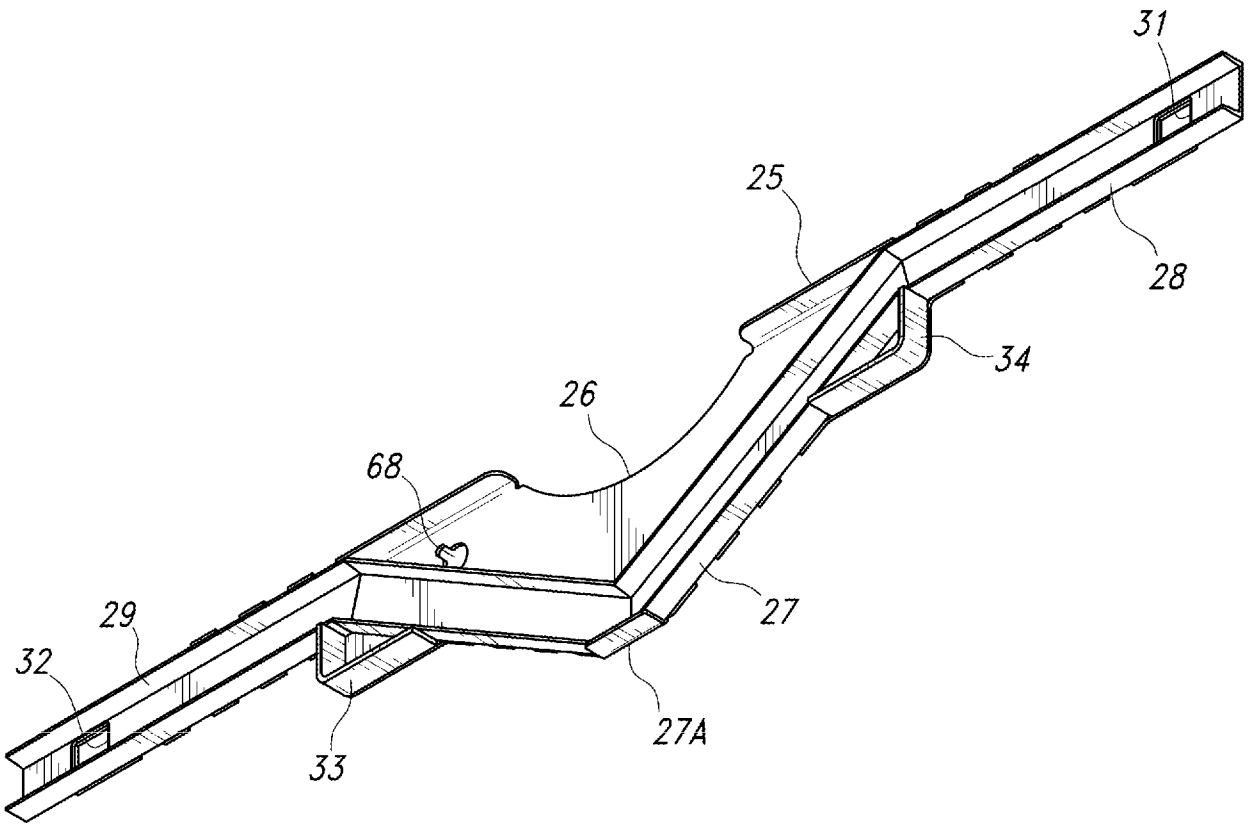
FIG. 5 is a rear perspective view of the exemplary crossbeam.

Referring now specifically to the drawings, a boat cradle assembly according to one exemplary embodiment of the present disclosure is illustrated in FIGS. 1 and 2 and shown generally at broad reference numeral 10. The exemplary cradle assembly 10 is especially applicable for lifting, transporting and dry storing a multi-hull pontoon boat 11 comprising a tubular midline pontoon 12 and tubular outside pontoons 13, 14 along port and starboard sides of the boat 11. The buoyant airtight pontoons 12, 13, 14 are located beneath a flat continuous deck 15 in spaced apart parallel relationship to one another. In a typical construction, the deck 15 of the boat 11 comprises a vertical passenger wall 16 extending about its perimeter and defining a passenger space 18 with suitable seating 19. The three pontoons 12, 13, 14 extend continuously from fore to aft of the boat 11. One example of a tri-hull pontoon boat of typical construction is illustrated in prior published U.S. Publication No. 2009/0031939 by Bennington Marine, LLC of Elkhart, Indiana. The complete disclosure of this prior art is incorporated herein by reference. In alternative embodiments, the present boat cradle assembly 10 may be applicable for lifting, transporting and dry storing other boat types and styles comprising a single rounded center hull.

As shown in FIGS. 1 and 3-6, the exemplary boat cradle assembly 10 incorporates spaced apart longitudinal metal side beams 21, 22 and a number of spaced apart identical metal crossbeams 24. Each crossbeam 24 (best shown in FIGS. 4-6) has a top structure 25 defining an intermediate arcuate formation 26, a substantially V-shaped bottom structure 27, and opposing arms 28, 29 extending horizontally from the V-shaped bottom structure 27 to the side beams 21, 22. The arms 28, 29 define respective openings 31, 32 for receiving the side beams 21, 22. Each crossbeam 24 is further reinforced by gussets 33, 34. During assembly, the crossbeams 24 are slid into position along a length of the side beams 21, 22 and are welded to the side beams at a desired spacing-either equally spaced from one another or spaced more closely at either or both ends of the assembly 10. A longitudinal center beam 35 is then welded to each crossbeam 24 at a vertex 27A of the V-shaped bottom structure 27. In exemplary embodiments, the crossbeams 24 are fabricated of machined, cut and formed anodized aluminum plate reinforced with one or more extruded anodized aluminum U-channels. The side beams 21, 22 comprise extruded anodized aluminum open-end square tubes, while the center beam 35 comprises a continuous anodized aluminum U-channel. Each of the side beams 21, 22, crossbeams 24 and center beam 35 have a high strength to weight ratio, are corrosion-resistant and resistant to stress cracks, and are readily machined, cut, formed and welded. The wall thickness of each beam 21, 22, 24, 35 may range from 1/16 inch to 1/4 inch.

Figure 6:
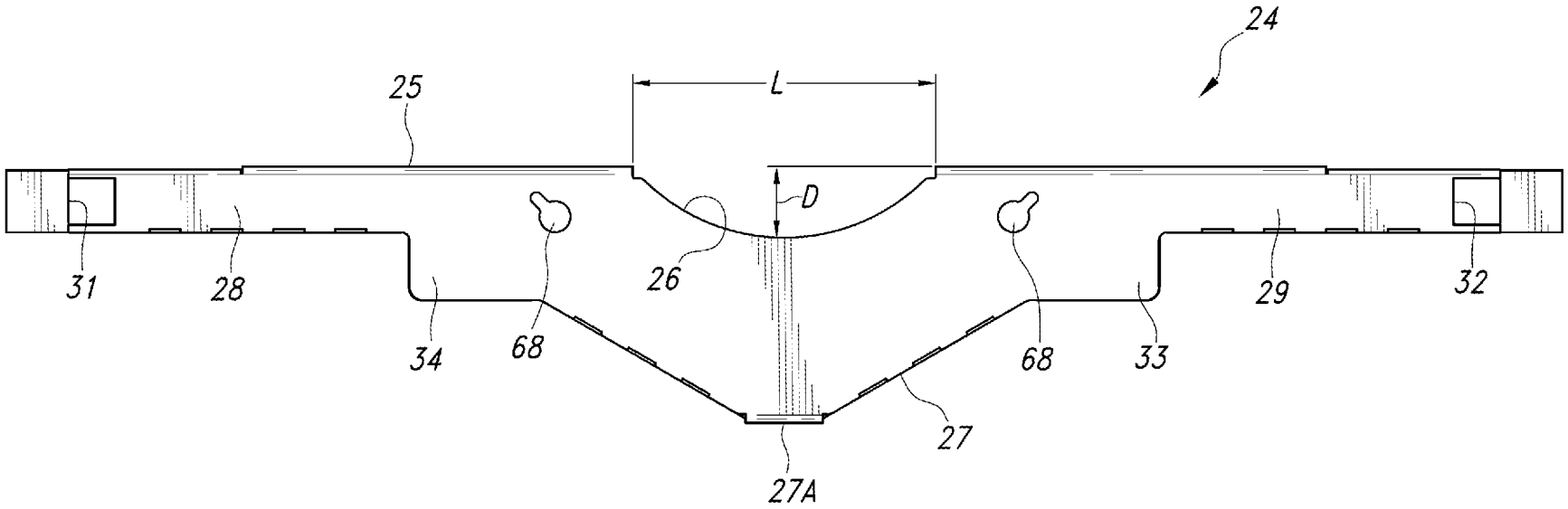
FIG. 6 is front plan view of the exemplary crossbeam.
Figure 7:
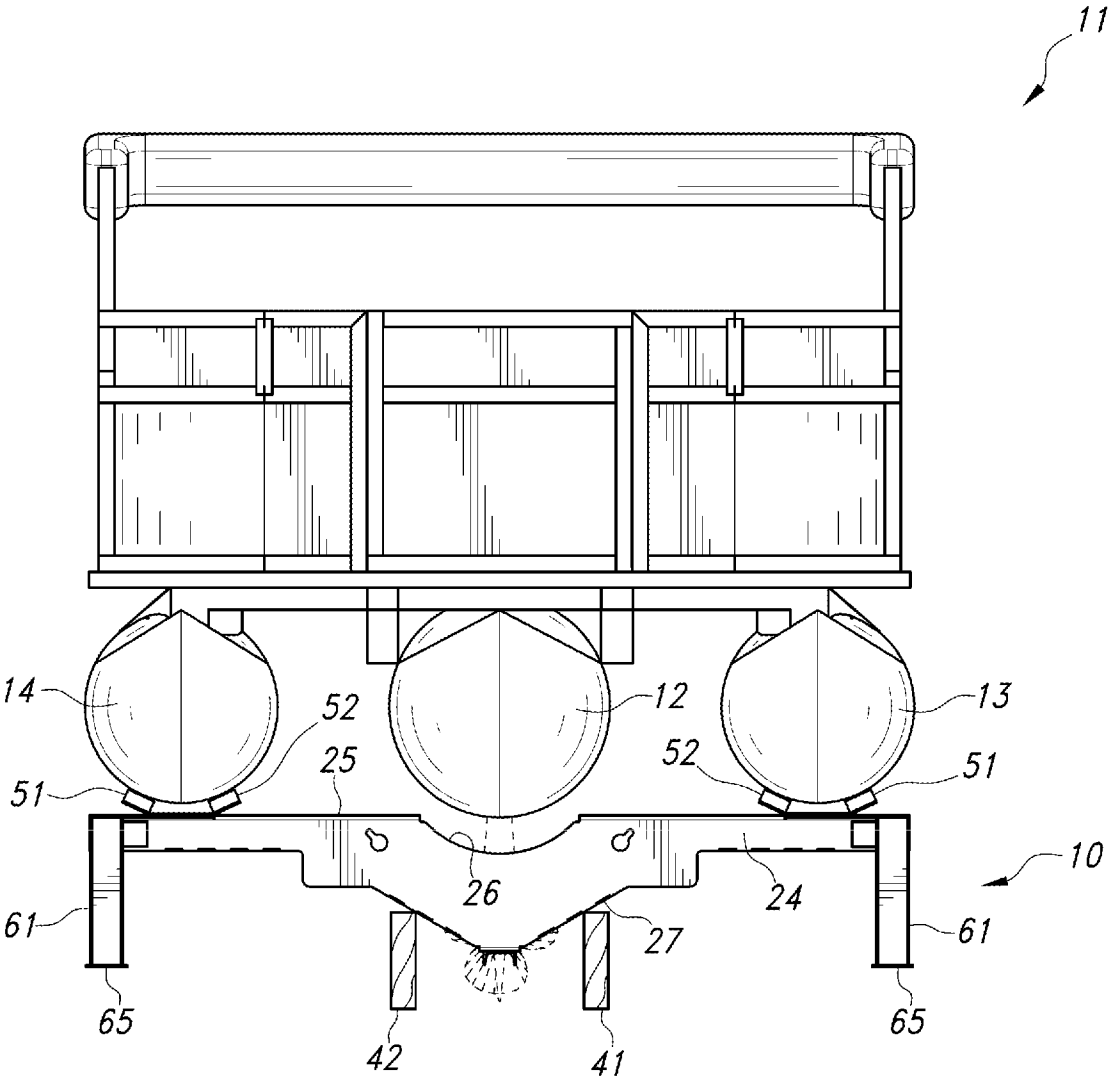
FIGS. 7 and 8 are front and rear end views of the exemplary boat cradle assembly carrying the multi-hull pontoon boat.
Figure 8:
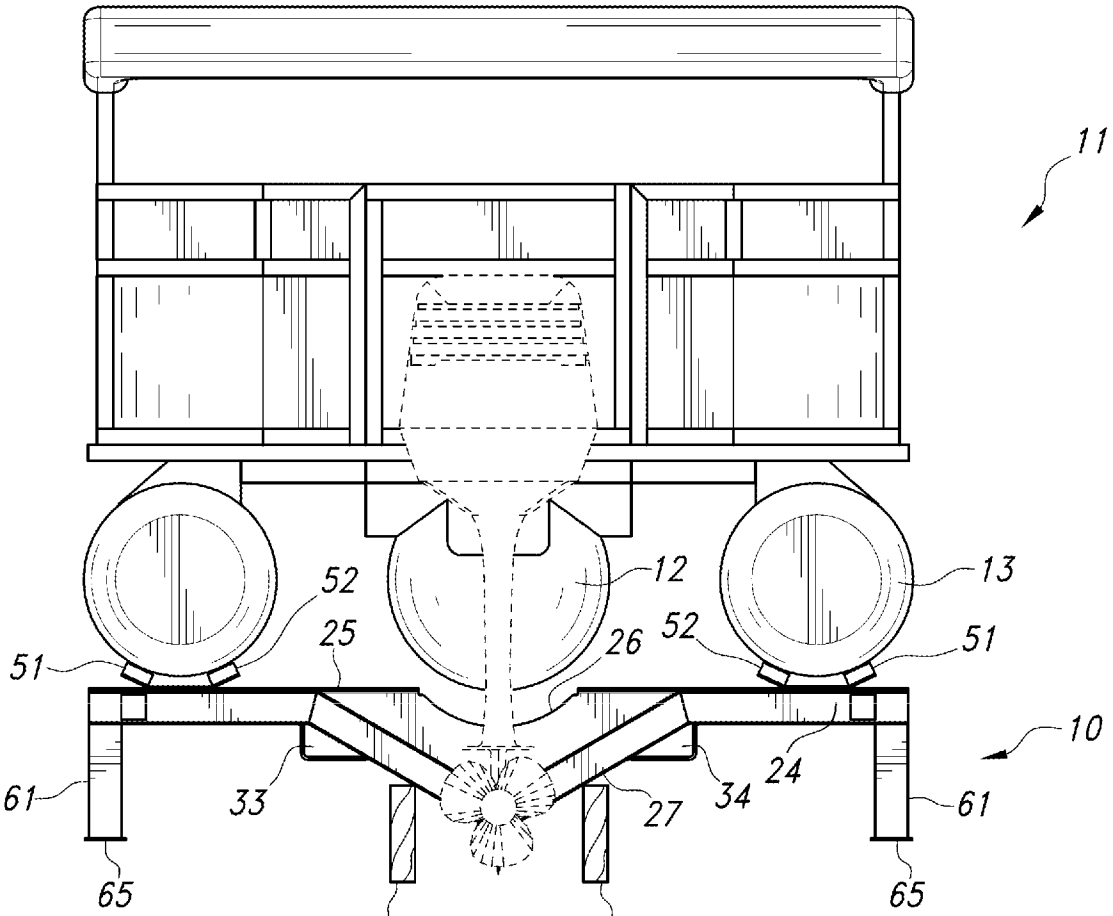

Referring to FIGS. 6, 7 and 8, the V-shaped bottom structure 27 of each crossbeam 24 is configured to reside between and engage spaced apart frame members 41, 42 of a dry storage rack. The intermediate arcuate formation 26 in the top structure 25 of each crossbeam 24 is configured to accommodate a rounded underside of the midline pontoon 12 of boat 11. In exemplary embodiments, arcuate formation 26 extends along a length "L" (FIG. 6) less than 50% of an entire length of the crossbeam 24, and has a centerpoint depth "D" of less than 6 inches. Identical pairs of cooperating longitudinal wood or aluminum bunk boards 51, 52 extend adjacent respective side beams 21, 22, and are mounted on a plurality of angled metal bunk brackets 54 affixed (e.g., welded) to the cradle assembly 10 at opposite ends of each crossbeam 24. The pairs of bunk boards 51, 52 are configured to engage respective tubular outside pontoons 13, 14 along port and starboard sides of the boat 11. The bunk boards 51, 52 extend continuously from one end of the boat cradle assembly 10 to the opposite end, and may be covered or wrapped with carpet or other protective material (not shown).

Referring again to FIGS. 1 and 3, the exemplary boat cradle assembly 10 may further comprise a number of short vertical legs 61 mounted to respective flat metal leg brackets 62 affixed adjacent the bunk brackets 54 at opposite ends of each crossbeam 24. The vertical legs 61 are of identical length and construction, extending downwardly adjacent the side beams 21, 22 to a common point slightly beyond the center beam 35. The legs 61 cooperate to support the boat cradle assembly 10 on an underlying surface, and each leg 61 has an enlarged flat foot plate 65 for added stability. The legs 61 may be fabricated of anodized aluminum U-channels. Additionally, one or more of the crossbeams 24 may have small holes 68 for receiving tie-down straps, cords, or roping.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112 (f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A boat cradle assembly adapted for dry storage of a pontoon boat having a deck and a hull, the hull including two outside tubular pontoons and a midline tubular pontoon, said boat cradle assembly comprising:

first and second spaced apart longitudinal side beams;

cooperating pontoon-engaging supports adapted to engage respective outside tubular pontoons along port and starboard sides of the boat;

a plurality of crossbeams extending between said first and second side beams, and each crossbeam having a substantially V-shaped structure defining an intermediate open formation configured to accommodate the midline tubular pontoon of the boat; and a longitudinal center beam attached to said plurality of crossbeams.

2. The boat cradle assembly according to claim 1, wherein each of said pontoon-engaging supports comprises a pair of cooperating bunk boards extending continuously from one end of said boat cradle assembly to an opposite end of said boat cradle assembly.

3. The boat cradle assembly according to claim 2, and comprising angled metal bunk brackets mounting said pairs of cooperating bunk boards at opposite ends of said crossbeams.

4. The boat cradle assembly according to claim 1, wherein said V-shaped structure of each crossbeam comprises spaced apart reinforcing gussets.

5. The boat cradle assembly according to claim 1, wherein each crossbeam further comprises opposing arms extending horizontally outward from said V-shaped structure.

6. The boat cradle assembly according to claim 1, wherein said center beam is affixed to each crossbeam at a vertex of the V-shaped bottom structure.

7. The boat cradle assembly according to claim 1, wherein said crossbeams are fabricated of aluminum.

8. A boat cradle assembly adapted for dry storage of a pontoon boat having a deck and a hull, the hull including multiple tubular pontoons, and said boat cradle assembly comprising:

first and second spaced apart longitudinal side beams;

a plurality of crossbeams extending between said first and second side beams, and each crossbeam having a substantially V-shaped structure defining an intermediate open formation configured to accommodate the hull of the boat; and cooperating pontoon-engaging supports located at opposite ends of said crossbeams and adapted to engage respective tubular pontoons along port and starboard sides of the boat.

9. A boat cradle assembly adapted for dry storage of a pontoon boat having a deck and a hull, the hull including multiple tubular pontoons, and said boat cradle assembly comprising:

first and second spaced apart longitudinal side beams;

a plurality of crossbeams extending between said first and second side beams, and each crossbeam having a substantially V-shaped structure defining an intermediate open formation, and wherein said open formations longitudinally align to form an unobstructed intermediate space extending downward towards a vertex of said crossbeams and configured to accommodate the hull of the boat; and cooperating pontoon-engaging supports located at opposite ends of said crossbeams and adapted to engage respective tubular pontoons along port and starboard sides of the boat.

* * * * *